US005495673A

United States Patent [19]

Gardiner et al.

[11] Patent Number: 5,495,673

[45] Date of Patent: Mar. 5, 1996

[54] KNIFE WITH DETACHABLE SUPPORT

[75] Inventors: Walter A. Gardiner, Waccabuc; Oleh Stecyk, Kerhonkson; David A. Swinden, Ellenville, all of N.Y.

[73] Assignee: Imperial Schrade Corp., Ellenville, N.Y.

[21] Appl. No.: 351,619

[22] Filed: Dec. 8, 1994

[51] Int. Cl.[6] ..... B26B 1/02

[52] U.S. Cl. ..... 30/155; 30/296.1

[58] Field of Search ..... 30/136, 136.5, 30/155–161, 143, 296.1

[56] References Cited

U.S. PATENT DOCUMENTS

| | | | |
|---|---|---|---|
| 929,295 | 7/1909 | Eilers . | |
| 1,217,154 | 2/1917 | Colvin . | |
| 2,647,311 | 8/1953 | Arden | 30/156 |
| 2,839,831 | 6/1958 | Baer | 30/155 |
| 4,563,813 | 1/1986 | Fortenberry | 30/161 |
| 4,773,159 | 9/1988 | Casazza, Jr. | 30/155 |
| 5,400,509 | 3/1995 | Collins | 30/155 |

*Primary Examiner*—Hwei-Siu Payer
*Attorney, Agent, or Firm*—Kirschstein et al.

[57] ABSTRACT

A support clip or sheath is detachably mounted on a knife. The clip or sheath has a locking portion insertable into a cavity of the knife, and a release button is operable for releasing the clip or sheath therefrom. A plurality of mounting apertures on the clip or sheath is attachable to various objects, such as a keyring or a strap. The knife and/or the objects are separately handled upon detachment of the clip or sheath. The knife is suspendable by the clip or sheath from a carrier such as a belt or strap.

24 Claims, 4 Drawing Sheets

KNIFE WITH DETACHABLE SUPPORT

BACKGROUND OF THE INVENTION

1. Field of the Invention

This invention generally relates to a knife and, more particularly, to a detachable support from which objects such as keyrings are supported and/or by which the knife itself is supported.

2. Description of the Related Art

It is known, for example, from U.S. Pat. No. 1,217,154 to mount a clip on one side of a knife blade for suspending a knife frown one's belt. Similarly, U.S. Pat. No. 2,839,831 discloses the attachment of a folding shackle on opposite sides of a pocket knife. Although generally satisfactory for their intended purpose, the mounting of a clip or shackle on one or both sides of such known knives imparts undesirable bulkiness to the knife, and also presents edges, some of which are pointed. Pointed edges are especially disadvantageous for a pocket knife, since they can tear the fabric of one's pocket, and injure a user. Also, pocket knives are often accompanied in one's pocket by other articles such as keys, money clips, wallets, etc. A bulky pocket knife which occupies too much space in one's pocket is likely to be left behind, thereby defeating its intended use.

It is also known, for example, from U.S. Pat. No. 929,295 to provide a nonremovable apertured lug at the back end region of a knife. A ring or chain link extends through the apertured lug. Items may be supported from the ring or link. Although generally satisfactory for its intended purpose, the non-removable mounting of a lug on such a knife is disadvantageous, because one cannot separate the knife from the lug and the items supported thereon, or the chain connected thereto.

It is also generally known, especially in the art of fixed, large knives to position the blades in protective leather sheaths in order to prevent personal injury or property damage. Such sheaths, however, cannot support items other than the knives themselves.

SUMMARY OF THE INVENTION

OBJECTS OF THE INVENTION

It is a general object of this invention to provide a compact, slim, non-bulky, knife which can be conveniently and quickly secured to, and removed from, a carrier, such as a user's belt, a link on a backpack, etc.

Another object of this invention is to provide such a knife for convenient and rapid attachment to, and detachment from an object, such as a keyring for a set of keys.

Still another object of this invention is to provide a readily attachable and detachable clip for a knife.

Yet another object of this invention is to provide a readily attachable and detachable sheath for a knife.

FEATURES OF THE INVENTION

In keeping with these objects and others which will become apparent hereinafter, one feature of this invention resides, briefly stated, in a knife comprising a frame extending along a longitudinal axis between a back end region and a front end region. A blade is fixed or movably mounted on the frame at the front end region.

In accordance with this invention, one of the end regions has a cavity extending at least partly along the longitudinal axis. The invention includes a support having locking means insertable into the cavity for locking engagement with the frame, means for attaching an object, such as a ting or strap, to the support, and release means for releasing the locking means from the cavity to detach the support from the frame with the object attached to the support.

The one end region has opposite exterior sides, and an end face extending between these exterior sides. The cavity extends from the end face along the longitudinal axis between these exterior sides. The release memos advantageously includes a well at the one end region. The well extends through one of the exterior sides along a transverse axis generally perpendicularly to the longitudinal axis. The locking means advantageously includes a generally planar insert portion insertable along the longitudinal axis through the end face and into the cavity along an insertion direction. The locking means further includes a movable locking portion integral with the insert portion, and a button mounted on the locking portion for joint movement therewith. The locking portion is movable between a locked position in which the button is received and locked in the well, and an unlocked position in which the button is outside the well. The locking portion lies in a plane that is inclined relative to that of the insert portion in the locked position.

In order to facilitate insertion of the insert portion into the cavity, the button is provided with a generally wedge shape. Thus, the button has a leading end and a trailing end as considered along the insertion direction. The transverse thickness of the button increases from the leading end to the trailing end.

In order to resist unauthorized removal of the insert portion from the cavity, the well is provided with a polygonal configuration, and the button is likewise provided with a complementary polygonal shape. Other shapes, such as a circular well and button, are likewise within the spirit of the invention.

The attaching means advantageously includes an attachment portion having an aperture through which the object extends. In a preferred application, the object is a key ring that loops through the aperture and, of course, a set of keys is mounted on the keyring. In another preferred application, the object is a strap that loops through the aperture and also through a link on a backpack, or that loops around a belt worn by a user.

In another preferred embodiment, another cavity may be provided at the one end region in a side-by-side, mirror-symmetrical, relationship with the first-mentioned cavity. The insert portion is insertable in either one of said cavities. Also, the attachment portion preferably includes one or more such apertures.

As for the knife itself, the frame, in a preferred embodiment, includes a pair of frame members spaced apart of each other and bounding therebetween a blade-receiving compartment. The blade has a tang pivotably mounted on the front end region of the frame for movement between a closed position in which the blade is received in the compartment, and an open position in which the blade extends along the longitudinal axis past the front end region of the frame.

The knife may further include a spring plate mounted between the frame members and biased against a side surface of the tang. The spring plate lockingly engages the tang in the open position. An access opening for exposing a part of the spring plate is provided on the frame. In addition, a grip or fingerrest is fixed to the blade for assisting a user in manually pushing the blade from the closed position to the open position. The frame members have ornamental, textured exterior surfaces.

In the case of a movable blade knife, it is advantageous if the one end region is the back end region. The cavity is then a rear cavity that extends from a rear end face of the frame into the back end region between the exterior sides of the frame. The support, also termed a clip, is entirely located between the exterior sides of the back end region in the locked position. The attachment portion of the clip extends rearwardly past the back end region in the locked position.

In the case of a fixed blade knife, the frame could be provided with a rear cavity, and the support could be a rear-mounted clip, as described above for the case of a movable blade. However, it is advantageous in the case of a fixed blade if the one end region is the front end region. The cavity is then a front cavity that extends from a front end face of the frame into the front end region between the exterior sides of the frame. The support, also termed a sheath, extends forwardly past the front end region and has walls bounding an interior for receiving the fixed blade in the locked position. The attachment portion of the sheath is located at a forward end of the sheath, and has one or more apertures for attachment to an object.

Thus, in accordance with this invention the clip is not mounted on the sides of the knife, but rearwardly and with in the frame, thereby rendering the knife more compact than in the prior art constructions. Also, there are no pointed edges on the clip to damage clothing or injure users. The clip itself is easily inserted into the back end region of the frame with a single stroke, and locked in place with a snap-type action. The clip is also easily detached from the back end region by simply pressing a release button exposed at the bottom of the well. The placement of the button at the bottom of the well insures that accidental detachment of the clip is resisted. Once the knife and the clip are detached, the knife and the objects attached to the clip can be conveniently and separately manipulated.

As for the sheath, it is also not mounted on the sides of the knife, but forwardly and within the frame and in an enveloping relationship with the blade. The sheath is easily inserted into the front end region of the flame with a single stroke, and locked in place with a snap-type action. The sheath is also easily detached from the front end region by simply depressing a release button exposed at the bottom of the well. Once the sheath and the knife are detached, the knife and the objects attached to the sheath can be conveniently and separately handled.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
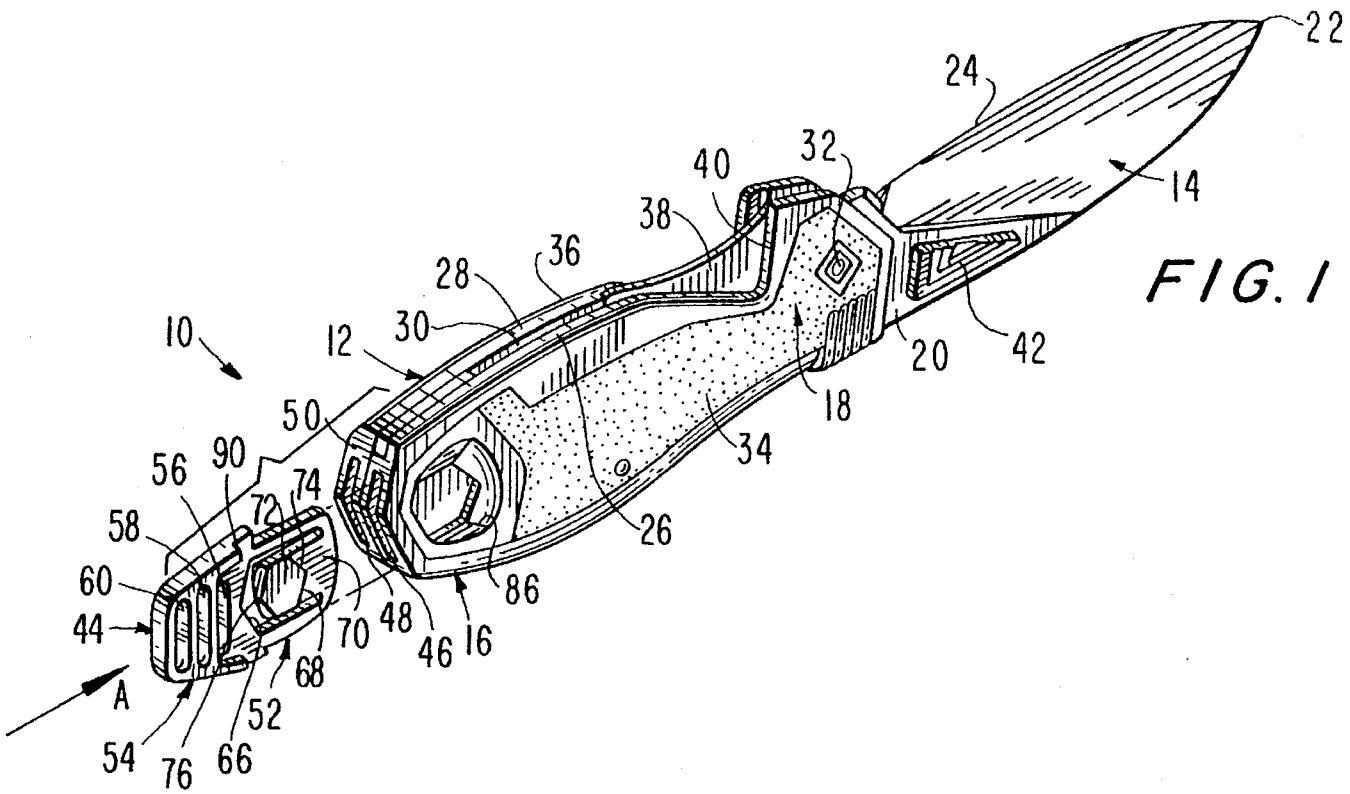
FIG. 1 is a perspective, exploded view showing a knife and a support clip prior to being attached to the knife in accordance with one embodiment of this invention.

Referring now to the drawings, reference numeral 10 generally identifies a knife having a plastic frame or handle 12 and a metal blade 14 that is movably mounted on the frame. The frame 12 is elongated and extends from a back end region 16 forwardly along a longitudinal axis to a front end region 18. The blade 14 is also elongated and extends from a back thickened blade portion or tang 20 to a pointed tip 22. A sharp cutting edge 24 extends along one longitudinal edge of the blade from the tang 20 to the tip 22.

As illustrated, the frame includes a pair of frame members 26, 28 spaced transversely apart of each other along a transverse axis perpendicular to the longitudinal axis. The frame members 26, 28 bound a blade-receiving compartment 30. The tang 20 is pivotably mounted at the front end region 18 for movement about a transverse pivot 32 between a closed position in which the blade is received in the compartment 30, and a use or open position (as illustrated) in which the blade extends along the longitudinal axis past the front end region 18. The frame members 26, 28 have exterior roughened surfaces 34, 36 for gripping purposes that are preferably ornamented and stylized for aesthetic purposes. The frame members 26, 28 are preferably injection molded of a glass-filled, hard, dense plastic resin for strength purposes.

A spring plate 38 (see FIG. 1) is mounted in the compartment 30 and has one end secured. e.g., by riveting, to one of the frame members. The spring plate 38 is constituted of a resilient metal material. Another resilient metal plate 21 (see FIG. 2) is mounted on the frame between the frame members. The opposite end of the spring plate 38 is self-biased constantly against the side of the tang 20. The metal plate 21 bears against and supplies tension to the end of the tang 20. The tang 20 has a non-illustrated, conventional notch which overlies the opposite end of the spring plate 38 in the open position. In all positions of the blade, except for the open position, the opposite end of the spring plate 38 bears against a side surface of the tang 20, and the end of the metal plate 21 bears against an end of the tang, both serving to resist the blade from wobbling or rocking. In the open position, the opposite end of the spring plate 38 enters the notch and locks the blade in the open position. An access opening 40 is formed in each frame member 26, 28 to enable a user to have access to the spring plate 38. The access opening 40 overlies and exposes a portion of the spring plate 38. The user pushes the exposed portion of the spring plate 38 against the spring force to push the opposite end of the spring plate out of the notch, thereby allowing the blade, now unlocked, to be returned to its closed position.

A grip 42 is fixed, e.g., by bonding or adhesion, to a side surface of the blade. The grip 42 provides a convenient fingerrest for the user to manually push the blade between its positions. The fingerrest has raised ribbed surfaces to facilitate its being gripped.

As described so far, the knife 10 is a pocket knife with a fold-in blade. However, the invention is not intended to be limited to such knives, but can equally well be used in conjunction with larger knives, and even knives having fixed blades, as described below in connection with FIGS. 7–11.

In accordance with one embodiment of this invention, a support clip 44 is detachably mounted at the back end region 16. Each frame member 26, 28 is molded with an interior rear cavity 46, 48 (see FIG. 1) spaced transversely apart of each other. The clip 44 is insertable in either cavity, as selected by the user. The back end region 16 has an exterior end face 50. Each rear cavity 46, 48 extends forwardly from this end face 50 along the longitudinal axis for a predetermined distance between the frame members 26, 28.

Figure 2:
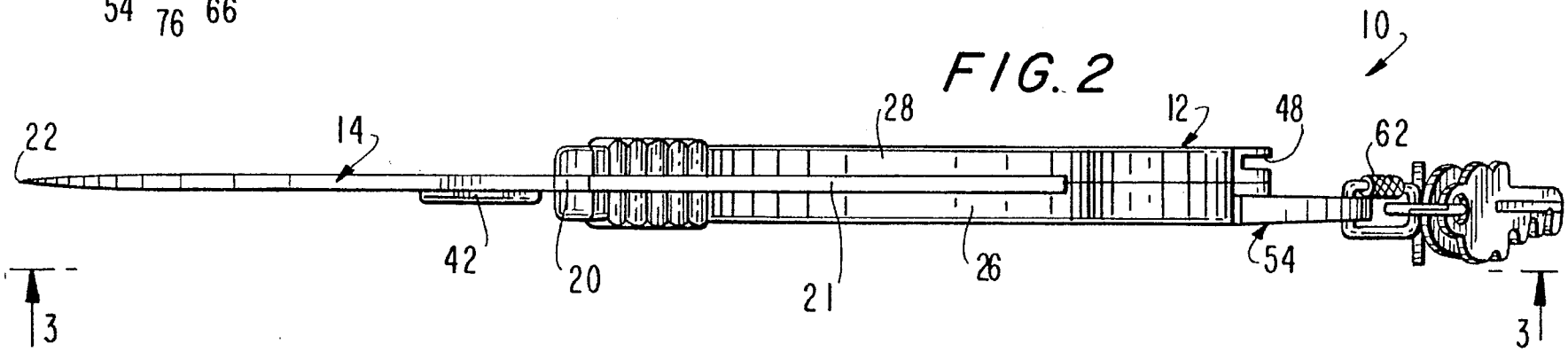
FIG. 2 is a bottom plan view of the knife of FIG. 1 with the clip attached and with a keychain supported from the clip.
Figures 3, 4, 5, 6:
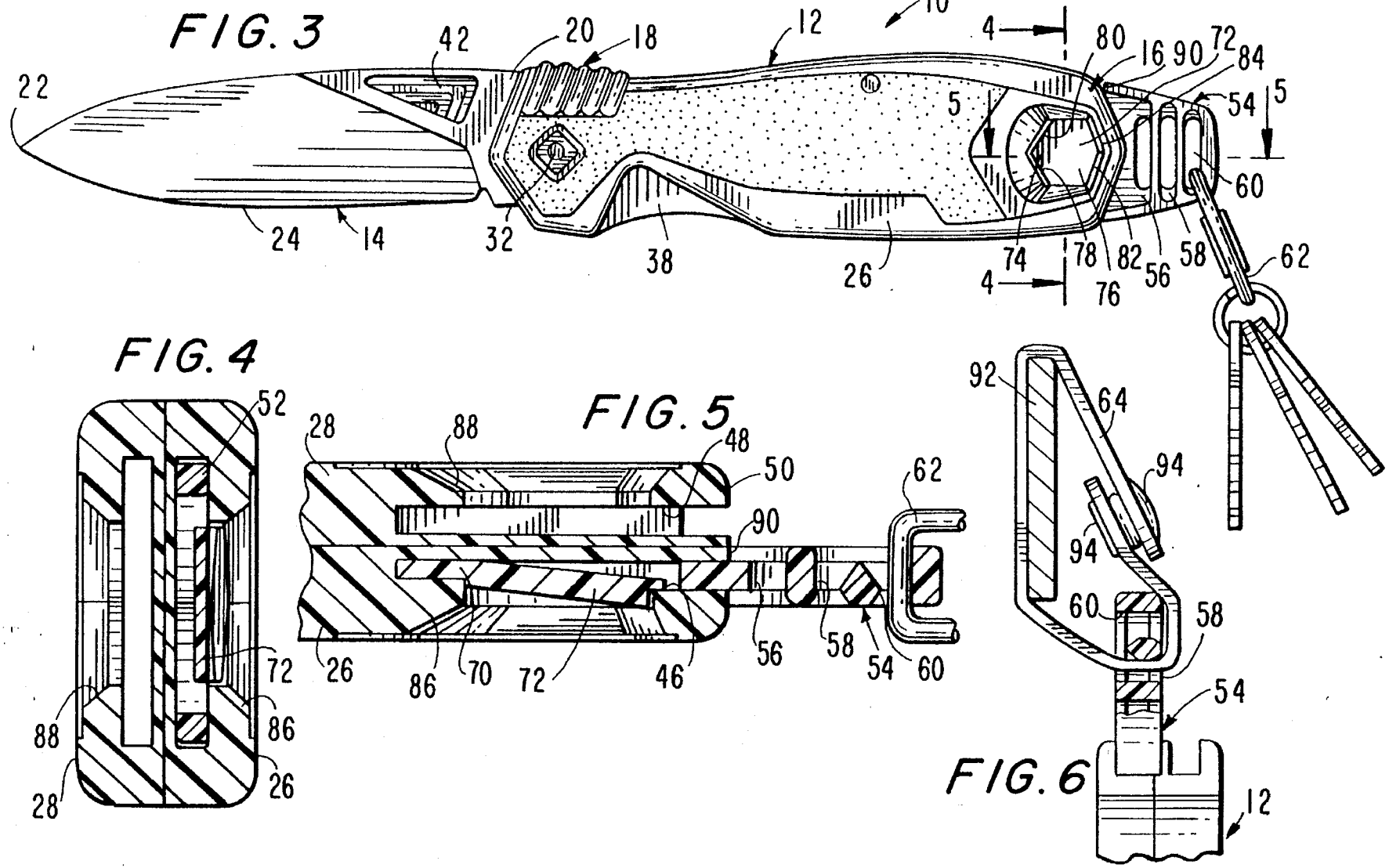
FIG. 3 is a side elevational view taken along the line 3—3 of FIG. 2.
FIG. 4 is an enlarged sectional view taken on line 4—4 of FIG. 3.
FIG. 5 is a broken-away sectional view taken on line 5—5 of FIG. 3.
FIG. 6 is a broken-away sectional view depicting the knife of FIG. 1 suspended from a belt loop in accordance with this invention.

The clip 44 includes a generally planar, leading, insert portion 52 insertable into a selected rear cavity 46, 48 along an insertion direction identified by the arrow A in FIG. 1, and a trailing attachment portion 54 which remains outside the rear cavity upon full insertion of the clip (see FIG. 3). The attachment portion 54 is provided with at least one mounting aperture and, as shown, three mounting apertures 56, 58, 60 spaced apart of one another along the longitudinal axis. As described below, objects such as a keyring 62, or a strap 64, are attached to the clip by being passed through one or more of the apertures. In the preferred embodiment, the apertures are elongated, have a generally rectangular outline, extend entirely through the clip, and are in mutual parallelism with one another.

The insert portion 52 has a generally U-shaped cutout 66 (see FIG. 1) that bounds a resilient tongue 68 that is attached to the insert portion 52 only at a living hinge 70. The clip is molded of a resilient plastic material, and the tongue 68 is simultaneously molded so that, in its detached state remote from the knife, the tongue 68 lies in a plane that is inclined relative to the plane of the insert portion 52.

A generally wedge-shaped, tapered, release button 72 is integrally molded on the tongue 68 at the end of the tongue that is opposite the hinge 70. The button 72 has raised edges elevated above the tongue.

As best shown in FIG. 3, the button 72 has a generally polygonal outline resembling a hexagon. Other shapes, both polygonal and non-polygonal, can be employed. The leading end 74 of the button includes a pair of leading edges 78, 80 elevated above the tongue at a predetermined height, and bounding an obtuse angle of a predetermined value. The trailing end 76 of the button includes a pair of trailing edges 82, 84 elevated above the tongue 68 at a height greater than said predetermined height, and bounding an obtuse angle of a value greater than said predetermined value. The greater obtuse angle for the edges 82, 84 serves to resist unauthorized removal of the clip. The lower elevation of the leading end of the button serves to facilitate insertion of the clip.

Each frame member 26, 28 is formed with a well 86, 88 (see FIG. 4) at the back end region 16. Each well extends through its respective frame member, and has a generally polygonal outline at the bottom of the well that is of complementary contour to that of the release button. The sides of each well flare outwardly toward the exterior surfaces 34, 36 so that the well opening at the top of the well is larger than at the bottom of the well, thereby facilitating accessibility.

In use, one holds the attachment portion 54 and inserts the insert portion 52 in the direction of arrow A into a selected cavity 46 or 48 in a single stroke. The button 72 on the inclined tongue 68 bears against an adjacent confronting wall of the selected cavity which, in turn, pushes the inclined tongue 68 against its inherent spring force into a generally co-planar relationship with the insert portion 52. An abutment shoulder 90 at the junction between the attachment and insert portions limits the insertion of the clip, and defines the fully inserted position, at which the button 72 is now positioned in an overlying relationship with the bottom of the well. The button 72, no longer being held by the confronting cavity wall, self-biases itself to enter the bottom of the well with a snap-type locking action. The clip, thus locked in the cavity, is held in this locked position in place, and is prevented from being unauthorizedly removed from the cavity by the abutment of the trailing edges 82, 84 against the well. To release the clip, it is merely necessary for the user to manually depress the button to an unlocking position in which the button is no longer situated within the well, and in which the tongue is again co-planar with the insert portion, and to thereupon pull the clip outwardly of the frame in a direction opposite to that of arrow A, again with a single pull stroke.

The keyring 62, together with a set of keys and like objects, are attached to the clip. The removal of the clip from the knife enables the keys to be handled, e.g., to open a door, without having to simultaneously handle the knife.

In another advantageous construction., as shown in FIG. 6, the knife 10 and clip 44 can be supported from any carder, e.g., a belt 92 worn about a user's waist, or a link on a backpack just to mention a few possibilities. Rather than opening the belt or link to attach the clip thereto, it is advantageous to pass the aforementioned strap 64, preferably provided with snap fasteners 94, through one of the mounting apertures 56, 58, 60. The knife is suspended from the clip mounted in either cavity as desired, the choice depending upon whether the user is right-or left-handed.

In still another construction, a single rear cavity could be provided at the back end region, preferably centrally of the knife.

Turning now to the embodiment of FIGS. 7–11, reference numeral 100 generally identifies a knife having a plastic frame or handle 112 and a metal blade 114 that is fixedly mounted on the frame. The frame 112 is elongated and extends from a back end region 116 forwardly along a longitudinal axis to a front end region 118. The blade 114 is also elongated and extends from a back thickened blade portion or tang 120 to a pointed tip 122. A sharp cutting edge 124 extends along one longitudinal edge of the blade from the tang 120 to the tip 122.

As illustrated, the frame includes a pair of frame members 126, 128 spaced transversely apart of each other along a transverse axis perpendicular to the longitudinal axis. The tang 120 is fixedly mounted at the front end region 118. The frame members 126, 128 have exterior roughened surfaces for gripping purposes that are preferably ornamented and stylized for aesthetic purposes. The frame members 126, 128 are preferably injection molded of a glass-filled, hard, dense plastic resin for strength purposes. A finger grip 142 provides a convenient fingerrest for the user to manipulate the knife.

In accordance with another embodiment of this invention, a support sheath 144 is detachably mounted at the front end region 118. Each frame member 126, 128 is molded with an interior front cavity 146, 148 (see FIG. 7) spaced transversely apart of each other. The front end region 118 has an exterior front end face 150. Each front cavity 146, 148 extends rearwardly from this end face 150 along the longitudinal axis for a predetermined distance between the frame members 126, 128.

Figure 9:
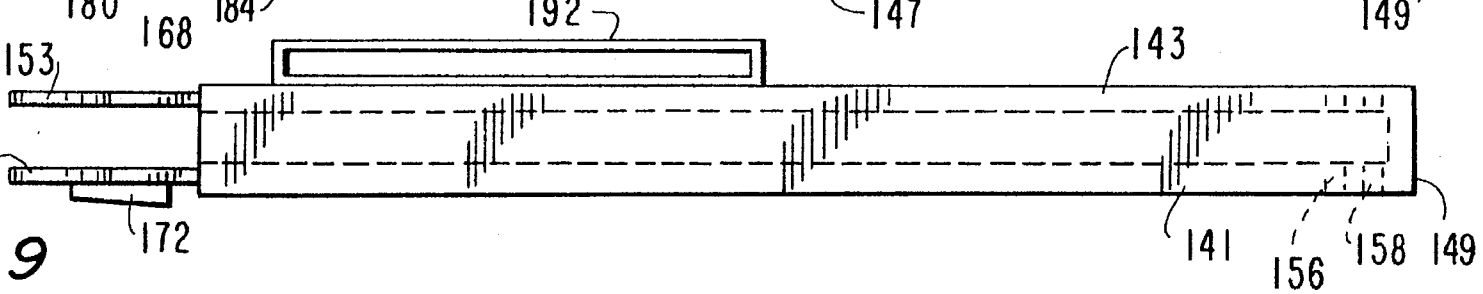
FIG. 9 is a top plan view of the sheath of FIG. 8.
Figure 10:
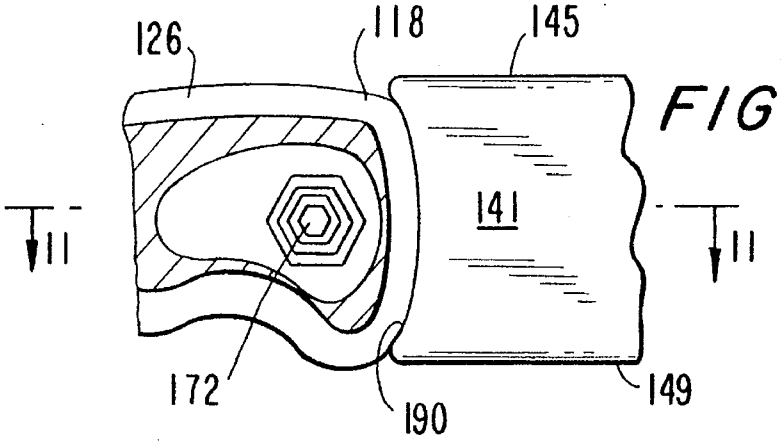
FIG. 10 is a broken-away, front elevational view showing the front end region of the knife of FIG. 7 attached to the sheath.

The sheath 144 includes an elongated housing have opposite side walls 141, 143; top and bottom walls 145, 147; and a closed end wall 149. As shown in FIG. 9, a generally planar, leading, insert portion 152 is generally co-planar with the side wall 141 and extends rearwardly thereof. A generally planar, stabilizer portion 153 is generally co-planar with the side wall 143 and extends rearwardly thereof. The insert and stabilizer portions 152, 153 are generally parallel to each other.

Figures 7, 11:
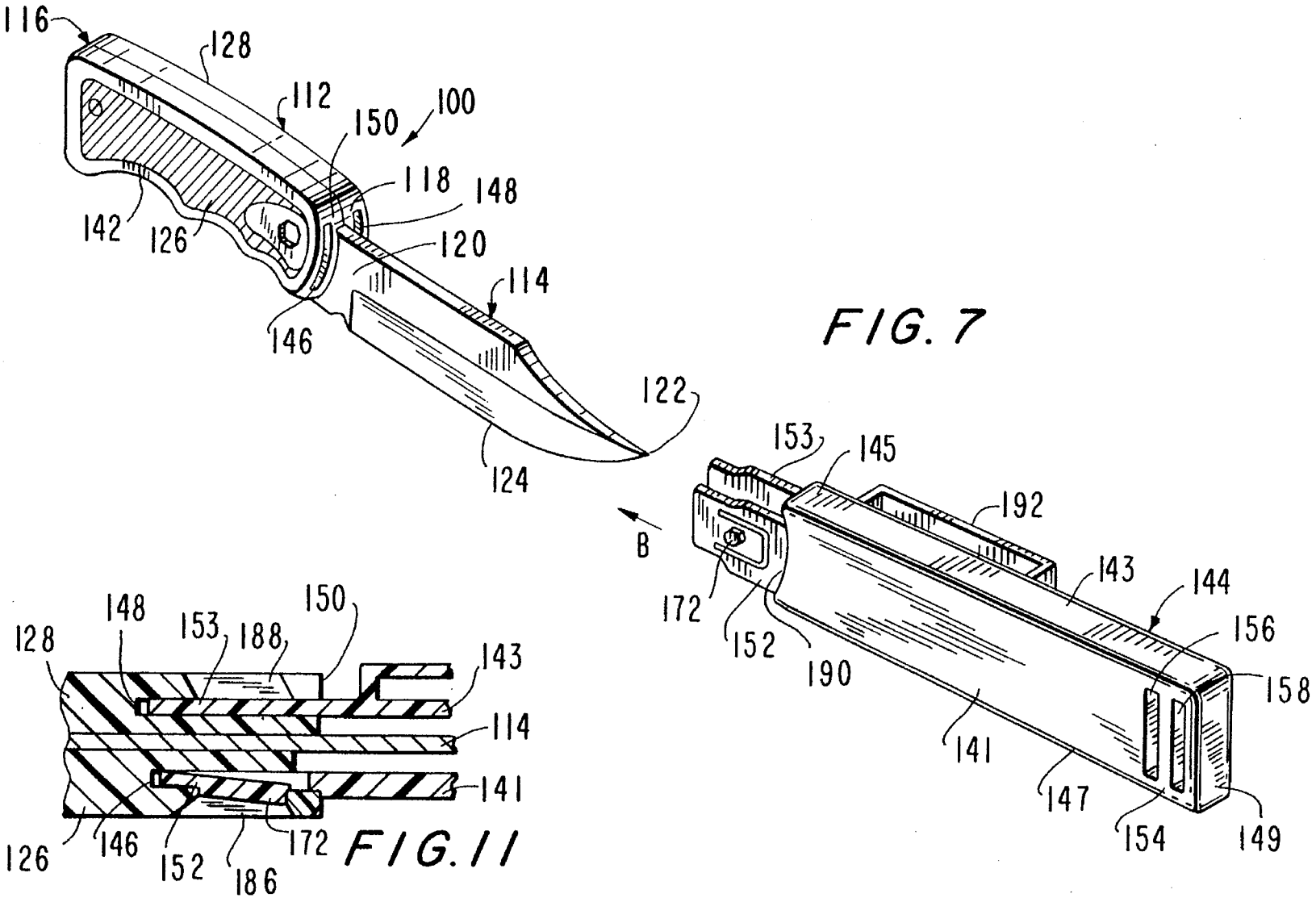
FIG. 7 is a perspective, exploded view showing a knife and a support sheath prior to being attached to the knife in accordance with another embodiment of this invention.
FIG. 11 is a broken-away, sectional view taken on line 11—11 of FIG. 10.

The insert portion 152 and the stabilizer portion 153 are insertable into the front cavities 146, 148 along an insertion direction identified by the arrow B in FIG. 7. The sheath could be turned upside down from its illustrated portion, in which case, the insert portion 152 and the stabilizer portion 153 are insertable into the front cavities 148, 146 respectively.

A trailing attachment portion 154 remains outside the front cavities upon full insertion of the sheath. The attachment portion 154 is provided with at least one mounting aperture and, as shown, two mounting apertures 156, 158 spaced apart of each other along the longitudinal axis. As described above, objects such as the keyring 62, or the strap 64, are attached to the sheath by being passed through one or more of the apertures. In the preferred embodiment, the apertures are elongated, have a generally rectangular outline, extend entirely through the sheath, and are in mutual parallelism with each other.

The insert portion 152 has a generally U-shaped cutout 166 (see FIG. 8) that bounds a resilient tongue 168 that is attached to the insert portion 152 only at a living hinge 170. The sheath is molded of a resilient plastic material, and the tongue 168 is simultaneously molded so that, in its detached state remote from the knife, the tongue 168 lies in a plane that is inclined relative to the plane of the insert portion 152.

A generally wedge-shaped, tapered, release button 172 is integrally molded on the tongue 168 at the end of the tongue that is opposite the hinge 170. The button 172 has raised edges elevated above the tongue.

Figure 8:
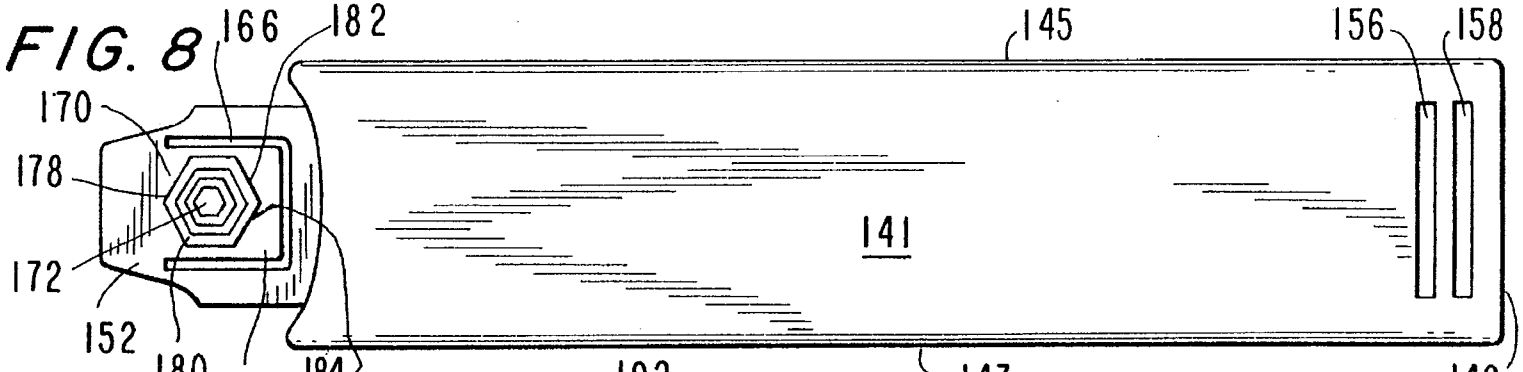
FIG. 8 is a front elevational view of the sheath of FIG. 7.

As best shown in FIG. 8, the button 172 has a generally polygonal outline resembling a hexagon. Other shapes, both polygonal and non-polygonal, can be employed. The leading end of the button includes a pair of leading edges 178, 180 elevated above the tongue at a predetermined height, and bounding an obtuse angle of a predetermined value. The trailing end of the button includes a pair of trailing edges 182, 184 elevated above the tongue 168 at a height greater than said predetermined height, and bounding an obtuse angle of a value greater than said predetermined value. The greater obtuse angle for the edges 182, 184 serves to resist unauthorized removal of the sheath. The lower elevation of the leading end of the button serves to facilitate insertion of the sheath.

Each frame member 126, 128 is formed with a well 186, 188 (see FIG. 11) at the front end region 118. Each well extends through its respective frame member, and has a generally polygonal outline at the bottom of the well that is of complementary contour to that of the release button. The sides of each well flare outwardly toward the exterior surfaces so that the well opening at the top of the well is larger than at the bottom of the well, thereby facilitating accessibility.

In use, one holds the attachment portion 154 and simultaneously inserts the insert portion 152 and the stabilizer portion 153 in the insertion direction of arrow B into the cavities 146, 148 in a single stroke. The button 172 on the inclined tongue 168 bears against an adjacent confronting wall of the selected cavity 146 which, in turn, pushes the inclined tongue 168 against its inherent spring force into a generally co-planar relationship with the insert portion 152. An abutment shoulder 190 limits the insertion of the sheath, and defines the fully inserted position, at which the button 172 is now positioned in an overlying relationship with the bottom of the well. The button 172, no longer being held by the confronting cavity wall, self-biases itself to enter the bottom of the well with a snap-type locking action. The sheath, thus locked in the cavity 146, is held in this locked position in place, and is prevented from being unauthorizedly removed from the cavity by the abutment of the trailing edges 182, 184 against the well. The stabilizer portion 153 assists in preventing the sheath from rocking from side to side. To release the sheath, it is merely necessary for the user to manually depress the button to an unlocking position in which the button is no longer situated within the well, and in which the tongue is again co-planar with the insert portion, and to thereupon pull the sheath outwardly of the frame in a direction opposite to that of arrow B, again with a single pull stroke.

The aforementioned keyring 62, together with a set of keys and like objects, are attached to the sheath by the apertures 156, 158. The removal of the sheath from the knife enables the keys to be handled, e.g., to open a door, without having to simultaneously handle the knife.

In another advantageous construction, the knife 100 and sheath 144 can be supported from any carder, e.g., the belt 92 worn about a user's waist, or a link on a backpack, just to mention a few possibilities. Rather than opening the belt or link to attach the sheath thereto, it is advantageous to pass the aforementioned strap 64, preferably provided with snap fasteners 94, through one of the mounting apertures 156, 158. The knife is suspended from the sheath.

In still another construction, an integral channel 192 could be provided at one of the side walls of the sheath. The user's belt could be directly routed through this channel.

In another variant construction rather than providing a single insert portion 152 with a locking tongue and button, the stabilizer portion 153 could be replaced by a second insert portion with another locking tongue and button. In this embodiment, both buttons would have to be depressed to release the sheath from the front cavities 146, 148.

It will be understood that each of the elements described above, or two or more together, also may find a useful application in other types of constructions differing from the types described above.

While the invention has been illustrated and described as embodied in a knife with detachable support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims.

We claim:

1. A knife, comprising:

a frame extending along a longitudinal axis between a back end region and a front end region, one of said end regions having a cavity extending along the longitudinal axis;

a blade mounted on the frame at the front end region; and a support having locking means insertable into the cavity for locking engagement with the frame, means, including an attachment portion having an aperture, for attaching an object extending through the aperture to the support, and release means for releasing the locking means from the cavity to detach the support from the frame with the object attached to the support.

2. The knife according to claim 1, wherein the frame includes a pair of frame members spaced apart from each other and bounding a blade-receiving compartment; and wherein the blade has a tang pivotably mounted on the frame for movement between a closed position in which the blade is received in the compartment, and an open position in which the blade extends along the longitudinal axis past the front end region of the frame.

3. The knife according to claim 2; and further comprising a grip fixed to the blade for manually pushing the blade from the closed position to the open position.

4. The knife according to claim 2; and further comprising a spring plate mounted between the frame members and biased against the tang, said spring plate lockingly engaging the tang in the open position.

5. The knife according to claim 4, wherein the frame has an access opening for exposing a part of the spring plate.

6. The knife according to claim 1, wherein said one end region has opposite exterior sides, and an end face extending between said exterior sides; and wherein the cavity extends from the end face along the longitudinal axis between said exterior sides.

7. The knife according to claim 6, wherein said one end region is the back end region, wherein said end face is a rear end face of the frame, and wherein said cavity is a rear cavity that extends through said rear end face.

8. The knife according to claim 7, wherein the support is a clip entirely located intermediate the exterior sides of the back end region when the clip is lockingly engaged in the rear cavity, and wherein the attaching means extends past the back end region along the longitudinal axis when the clip is lockingly engaged in the rear cavity.

9. The knife according to claim 6, wherein said one end region is the front end region, wherein said end face is a front end face of the frame, and wherein said cavity is a front cavity that extends through said front end face.

10. The knife according to claim 9, wherein the support is a sheath having walls bounding an interior for receiving the blade when the sheath is lockingly engaged in the front cavity, and wherein the sheath extends past the front end region along the longitudinal axis when the sheath is lockingly engaged in the front cavity.

11. The knife according to claim 6, wherein the release means includes a well at said one end region, said well extending through one of said exterior sides along a transverse axis generally perpendicular to the longitudinal axis; and wherein the locking means includes an insert portion insertable along the longitudinal axis through the end face and into the cavity along an insertion direction, a movable locking portion mounted on the insert portion, and a button mounted on the locking portion for joint movement therewith, said locking portion being movable between a locked position in which the button is received and locked in the well, and an unlocked position in which the button is outside the well.

12. The knife according to claim 11, wherein the insert portion lies in a plane extending along the longitudinal axis, and wherein the locking portion lies in a plane inclined relative to the plane of the insert portion in the locked position.

13. The knife according to claim 11, wherein the button has a leading edge and a trailing edge as considered along the insertion direction, and wherein the button has a transverse thickness that increases from the leading edge to the trailing edge.

14. The knife according to claim 11, wherein the well has a polygonal configuration, and wherein the button has a polygonal shape of complementary contour to the polygonal configuration of the well.

15. The knife according to claim 11, wherein the locking portion is of one piece with, and is hinged to, the insert portion.

16. The knife according to claim 11, whereto the support includes means for abutting the end face of said one end region in the locked position.

17. The knife according to claim 1, wherein the object is a ring that loops through the aperture.

18. The knife according to claim 1, wherein the object is a strap that loops through the aperture.

19. The knife according to claim 1, wherein the attachment portion has at least one additional aperture.

20. The knife according to claim 1; and further comprising another cavity extending along the longitudinal axis at said one end region in a side-by-side relationship.

21. The knife according to claim 20, wherein said one end region is the back end region, and wherein the locking means is insertable in either cavity.

22. The knife according to claim 20, wherein said one end region is the front end region, and wherein the locking means is insertable in one of the cavities and wherein the support includes a stabilizer insertable in the other of the cavities.

23. A knife comprising:

a frame extending along a longitudinal axis between a back end region and a front end region, one of said end regions having opposite exterior sides, an end face extending between said exterior sides, and a cavity extending along the longitudinal axis from said end face between said exterior sides:

a blade mounted on the frame at the front end region; and a support having locking means insertable into the cavity for locking engagement with the frame, means for attaching an object to the support, and release means for releasing the locking means from the cavity to detach the support from the frame with the object attached to the support.

24. A knife, comprising:

a frame extending along a longitudinal axis between a back end region and a front end region, one of said end regions having a cavity extending along a plane along the longitudinal axis;

a blade mounted on the frame at the front end region; and a support having locking means, including a generally planar insert portion insertable along the longitudinal axis into the generally planar cavity for sliding, locking engagement with the frame, means for attaching an object to the support, and release means for releasing the locking means from the cavity to detach the support from the frame with the object attached to the support.

* * * * *